US010683658B1

(12) United States Patent
Poehner

(10) Patent No.: US 10,683,658 B1
(45) Date of Patent: Jun. 16, 2020

(54) PROTECTIVE ENCLOSURE WITH PRESSURIZATION CHAMBER

(71) Applicant: Marc Poehner, St Louis, MO (US)

(72) Inventor: Marc Poehner, St Louis, MO (US)

( * ) Notice: Subject to any disclaimer, the term of this patent is extended or adjusted under 35 U.S.C. 154(b) by 0 days.

(21) Appl. No.: 16/358,984

(22) Filed: Mar. 20, 2019

(51) Int. Cl.
*E04B 1/343* (2006.01)

(52) U.S. Cl.
CPC ..... *E04B 1/34357* (2013.01)

(58) Field of Classification Search
CPC ..... E04B 1/34357; E04B 1/169
USPC ..... 52/2.11
See application file for complete search history.

(56) References Cited

U.S. PATENT DOCUMENTS 2,689,812 A * 9/1954 Mollica ..... B29D 22/02 156/281
2,762,327 A * 9/1956 Weig ..... E01F 9/654 116/63 R
4,094,109 A * 6/1978 Prouvost ..... E04B 1/169 249/65
4,771,581 A * 9/1988 Nill ..... E02D 27/35 405/229
5,570,544 A * 11/1996 Hale ..... E04H 15/20 52/2.11
5,937,595 A * 8/1999 Miller ..... E06B 3/285 52/2.11
6,438,862 B1 * 8/2002 Soucy ..... F26B 3/286 34/135
6,453,840 B1 * 9/2002 Higginbotham ..... B63B 7/08 114/345
6,467,221 B1 * 10/2002 Bigelow ..... B64D 11/00 244/171.9
7,562,493 B2 * 7/2009 Kassianoff ..... A01G 9/1415 52/2.25
7,748,169 B2 * 7/2010 Cote ..... E06B 9/02 52/2.11
8,668,974 B2 * 3/2014 Purdy ..... B29C 44/06 428/36.4
2002/0184841 A1 * 12/2002 Diamond ..... E06B 9/02 52/203
2003/0061776 A1 * 4/2003 Alderman ..... E04B 1/76 52/404.1
2006/0059788 A1 * 3/2006 Kassianoff ..... A01G 9/1415 52/2.11

(Continued)

*Primary Examiner* — Babajide A Demuren
(74) *Attorney, Agent, or Firm* — Gulf Coast Intellectual Property Group

(57) ABSTRACT

A portable enclosure that is configured to be surroundably mounted at least one object to provide protection thereof wherein said portable enclosure is further configured to inhibit moisture within the interior volume thereof. The portable enclosure of the present invention includes a body wherein the body includes at least one body segment having at least one wall. The body is provided in alternate sizes and shapes and includes mateable end cap members. The wall of the body is configured with perimeter seams that are equipped with fasteners operable to provide expansion of the body segment. A pressurization chamber is operably coupled to the wall of the body and configured to provide a pressure within the interior volume of the portable enclosure that is greater than that of its surroundings. The pressurization chamber combines an airflow pattern and a water reducing member to facilitate the reduction of moisture.

17 Claims, 7 Drawing Sheets

(56) References Cited

U.S. PATENT DOCUMENTS

2006/0260210 A1* 11/2006 Tanielian ..... E01F 13/12 52/2.11
2008/0190032 A1* 8/2008 Roelofs ..... E21F 17/107 49/463
2009/0019784 A1* 1/2009 Tinker ..... B64G 1/222 52/2.11
2009/0038615 A1* 2/2009 Bradley ..... A61B 5/097 128/204.17
2009/0139172 A1* 6/2009 Harinishi ..... E04F 15/22 52/403.1
2009/0249700 A1* 10/2009 Peterson ..... A45F 3/08 52/2.17
2009/0320380 A1* 12/2009 Chelf ..... F24F 7/007 52/2.11
2010/0058672 A1* 3/2010 Bayne ..... A01G 9/1415 52/2.11
2010/0101152 A1* 4/2010 Gordon ..... E01D 15/122 52/2.11
2010/0281783 A1* 11/2010 Harrington ..... E04H 9/14 52/2.23
2011/0183600 A1* 7/2011 Chua ..... F24F 7/06 454/358
2012/0117891 A1* 5/2012 Gower ..... E06B 9/02 52/2.11
2012/0291362 A1* 11/2012 Milo ..... E04B 1/165 52/2.18
2013/0318885 A1* 12/2013 Griffis ..... E04B 1/34357 52/2.11
2013/0326902 A1* 12/2013 Barrows ..... F26B 25/18 34/282
2014/0007451 A1* 1/2014 Brown, Jr. ..... A01F 25/00 34/265
2014/0137569 A1* 5/2014 Parish ..... F25B 21/02 62/3.2
2015/0101258 A1* 4/2015 Milo ..... E04H 15/20 52/2.18

* cited by examiner

PROTECTIVE ENCLOSURE WITH PRESSURIZATION CHAMBER

CROSS REFERENCE TO RELATED APPLICATIONS

This non-provisional application is a continuation in part of U.S. patent application Ser. No. 15/654,172 filed, Jul. 19, 2017, entitled, Locking Seal Device, which is hereby incorporated for reference

FIELD OF THE INVENTION

The present invention relates generally to protective enclosures, more specifically but not by way of limitation, a protective enclosure that is configured to surroundably secure an object or be superposed thereto wherein the protective enclosure has a pressure within the interior volume thereof that is greater than that of its surroundings.

BACKGROUND

Protective apparatus are well known in the art and range from temporary items such as but not limited to tarps to more elaborate structures such as but not limited to canopies and the like. These enclosures are utilized to provide protection for objects wherein it is desired to inhibit environmental conditions such as but not limited to rain and snow from contacting the objects. Objects such as but not limited to truck loads of furniture to golf carts are ideally stored such that they are not exposed to rain and other inclimate conditions.

One issue with conventional protection apparatus such as but not limited to tarps are their inability to inhibit contact of the object they are superposed with precipitation. Typical installation of tarps results in the ability for precipitation to egress into the area underneath the tarp and as such potentially damage the object that the tarp is superposed. Alternate enclosures may provide superior coverage to tarps but are unable to inhibit introduction of environmental moisture, which over a longer term can be detrimental to the object being covered. Existing technology that can provide environmental protection are typically rigid structures that are expensive and further cannot be stored and/or disposed in certain areas.

Accordingly, there is a need for portable enclosure that provides complete enclosure of an object or objects wherein the portable enclosure has a positively pressurized interior volume and further inhibits introduction of moisture and other matter thereinto.

SUMMARY OF THE INVENTION

It is the object of the present invention to provide a protective enclosure configured to surroundably mount at least one object and provide protection thereof wherein the protective enclosure includes a body that is manufactured from a flexible material.

Another object of the present invention is to provide a protective enclosure that includes an interior volume having a pressure that is greater than that of its environment wherein the body includes a pressurization chamber operably secured thereto.

A further object of the present invention is to provide a protective enclosure configured to surroundably mount at least one object and provide protection thereof wherein the pressurization chamber provides reduction of the air velocity therein prior to entrance into the interior volume of the body.

Yet a further object of the present invention is to provide a protective enclosure that includes an interior volume having a pressure that is greater than that of its environment wherein the pressurization chamber is formed in such a manner so as to facilitate the reduction of moisture and other matter of the air therein prior to the air being introduced into the interior volume of the body.

Still another object of the present invention is to provide a protective enclosure configured to surroundably mount at least one object and provide protection thereof wherein the body includes end caps formed in a plurality of shapes that provide alternate styles and shapes of the body.

An additional object of the present invention is to provide a protective enclosure that includes an interior volume having a pressure that is greater than that of its environment wherein the body includes an air inlet formed therein that is atmospherically coupled with the pressurization chamber and is operable to provide back pressure within the pressurization chamber.

Yet a further object of the present invention is to provide a protective enclosure configured to surroundably mount at least one object and provide protection thereof wherein an embodiment of the body of the present invention includes a plurality of zippered panels that are configured to facilitate the expansion or contraction thereof.

Another object of the present invention is to provide a protective enclosure that includes an interior volume having a pressure that is greater than that of its environment wherein the pressurization chamber includes a hydro-membrane that is configured to assist in the removal of moisture and other matter of the air prior to being dispersed into the interior volume of the body.

An alternate object of the present invention is to provide a protective enclosure configured to surroundably mount at least one object and provide protection thereof wherein the hydro-membrane includes a plurality of miniscule apertures that allow water to propagate therethrough.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
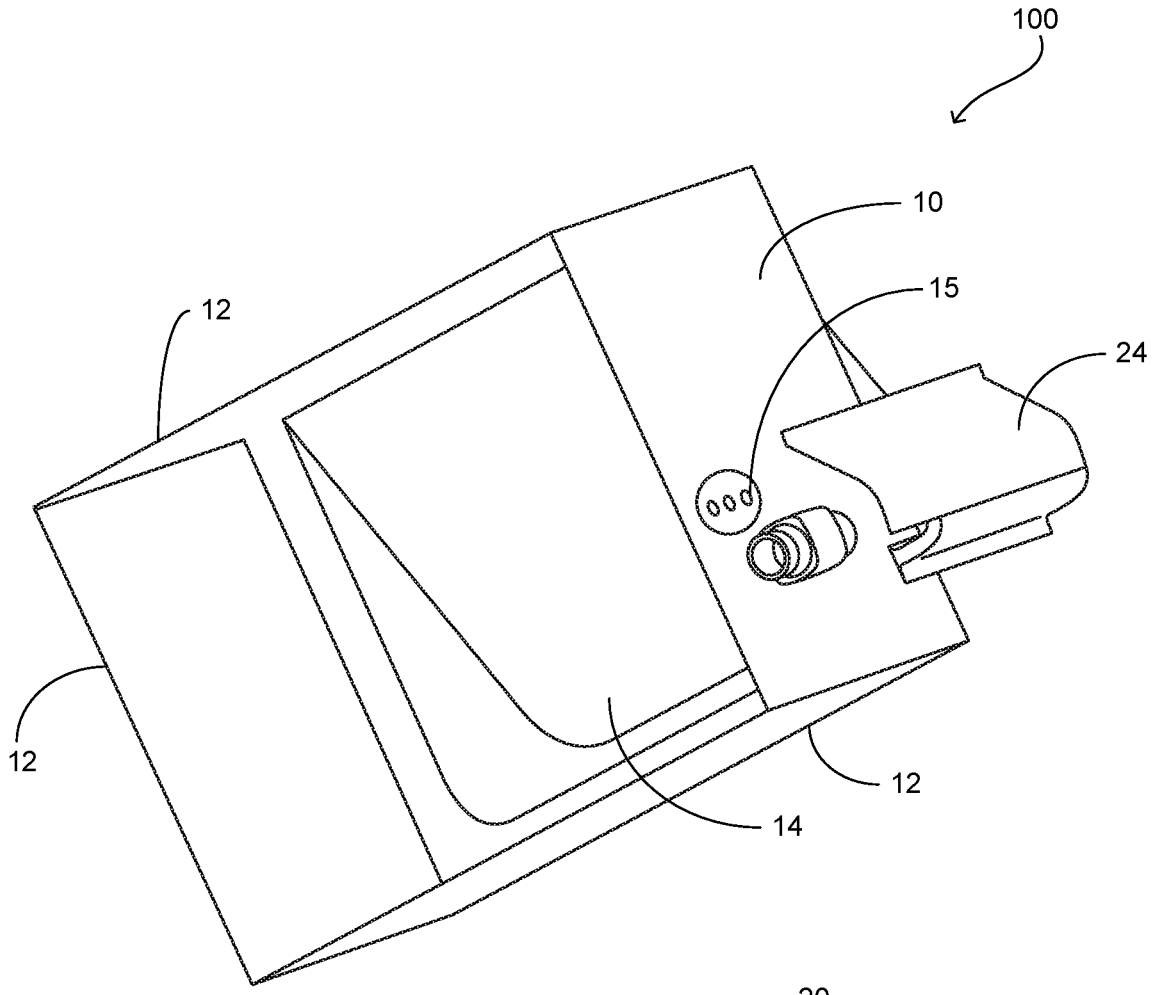
FIG. 1 is rear perspective view of an embodiment of the present invention.

Referring now to the drawings submitted herewith, wherein various elements depicted therein are not necessarily drawn to scale and wherein through the views and figures like elements are referenced with identical reference numerals, there is illustrated protective enclosure with pressurization chamber 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Figure 2:
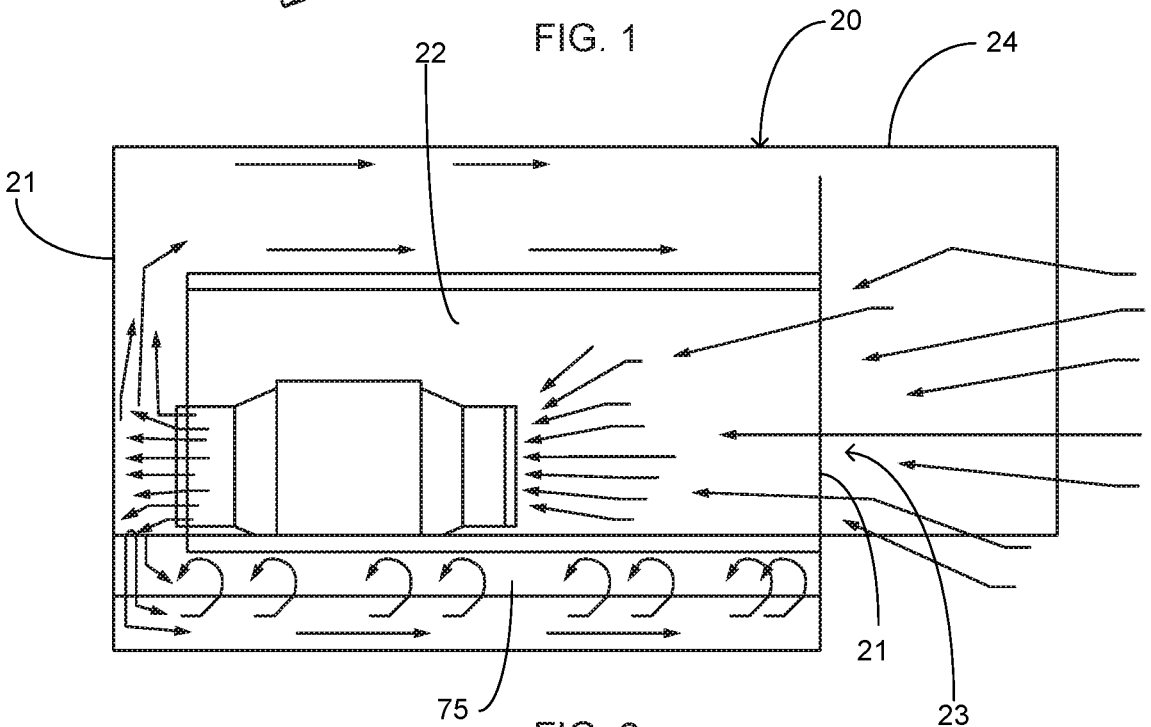
FIG. 2 is a diagrammatic view of the pressurization chamber of the present invention.

Referring in particular to the FIGS. 1 and 2 herein the protective enclosure with pressurization chamber 100 includes a body 10 wherein the body 10 includes a plurality of walls 12 that are integrally formed to create an interior volume 14. The body 10 is manufactured from a durable flexible material such as but not limited to nylon. As will be further discussed herein, the body 10 is configured to be expandable and provided in various sizes and shapes so as to provide enclosure of alternate objects. The body 10 is configured to have apertures 15 journaled through the wall 12 wherein the apertures 15 are operable to atmospherically couple the pressurization chamber 20 and the interior volume 14 of the body 10. The apertures 15 are manufactured in quantity and size so as to provide restriction of the airflow passing therethrough. The restriction of the airflow passing through the apertures 15 provides the desired back pressure within the pressurization chamber 20 so as to promote removal of moisture and other matter that is further discussed herein. It is contemplated within the scope of the present invention that the body 10 could have alternate quantities and sizes of apertures 15 so as to provide the desired objectives discussed herein. It should be understood within the scope of the present invention that the body 10 could have as few as one aperture 15 or more than three apertures 15.

Figure 9:
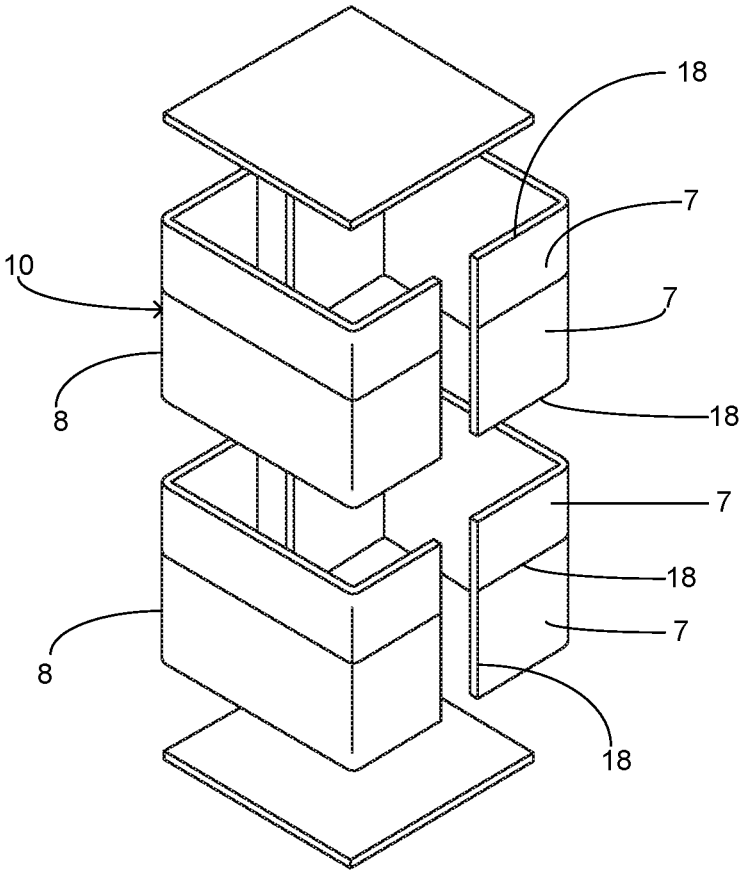
FIG. 9 is a perspective view of an exemplary body panel and end cap configuration of the present invention.
Figure 10:
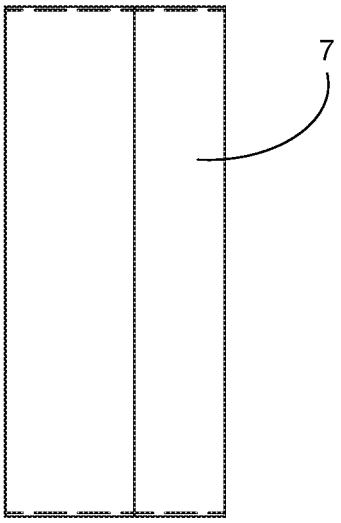
FIG. 10 is a side view of an exemplary body panel of the present invention.
Figure 11:
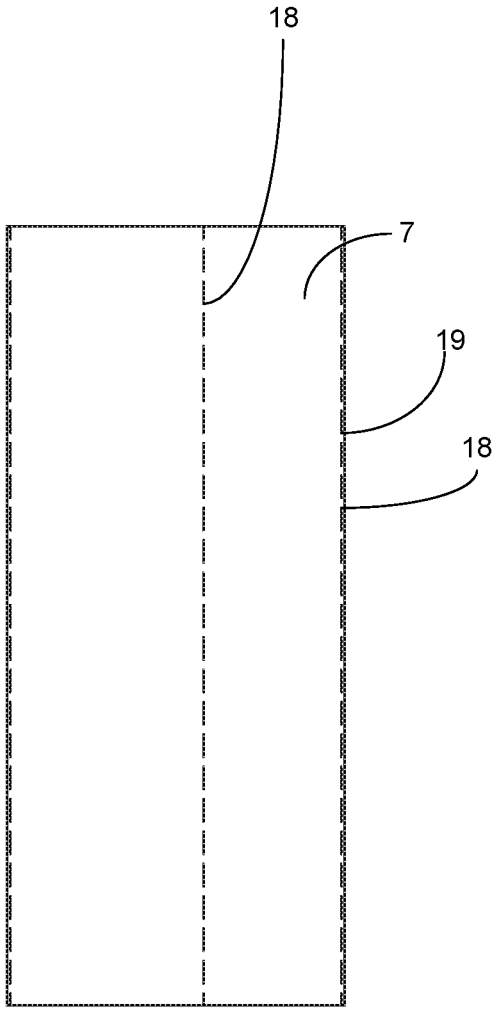
FIG. 11 is a side view of an exemplary body panel of the present invention.
Figure 12:
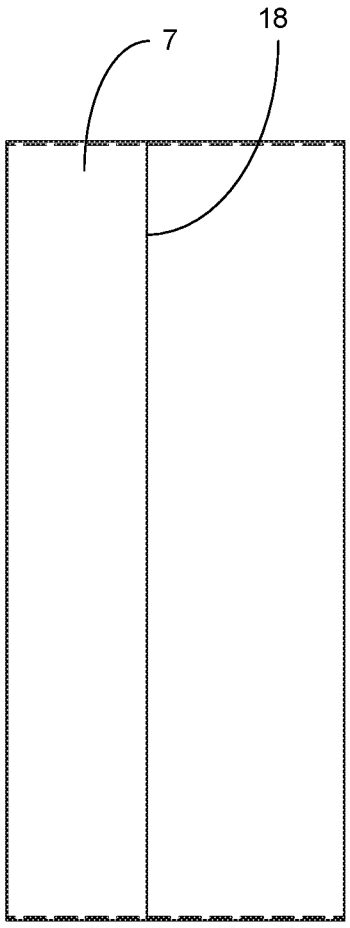
FIG. 12 is a side view of an exemplary body panel of the present invention.

Referring in particular to FIGS. 6 through 10 and 11 and 12, alternative embodiments of the body 10 are illustrated therein. The body 10 is configured with wall panels 7 that are operable to be expandable in order to provide alternate sizes of the protective enclosure with pressurization chamber 100. As shown in FIG. 9 herein, the body 10 can be comprised of more than one body segment 8. Furthermore, the body 10 and wall panels 7 are configurable in a plurality of shapes as illustrated herein. While a few exemplary shapes have been illustrated herein, it should be understood within the scope of the present invention that the body 10 could be formed in various shapes as required to provide enclosure of a particular object or to place the protective enclosure with pressurization chamber 100 in a desired location having a defined area shape.

The wall panels 7 include perimeter seams 18 wherein the seams are configured to provide the expansion and/or alteration of the size of the body 10. The perimeter seams 18 have integrated thereon a zipper or similar type fastener that facilitate the separation and/or expansion of the wall panels 7. It should be understood within the scope of the present invention that the perimeter seams 18 could be placed in alternate locations and alternate quantities in order to provide the desired expansion or sizing of the body 10. The fasteners 19 integrated into the perimeter seams 18 are mateable so as to couple/decouple in order to provide the desired sizing of the body 10.

The wall panels 7 have operably coupled thereto end cap members 30 that provide closure of the top and bottom of the body 10. The end cap members 30 are manufactured of a similar material as that of the body 10 and are planar in manner. The end cap members 30 include perimeter edge 31 that include fasteners (not particularly illustrated herein) that facilitate the releasably securing of the end cap members 30 to the wall panels 7 forming a complete enclosure defining an interior volume operable to receive and store objects therein. It should be understood within the scope of the present invention that the fasteners on the perimeter edge 31 could be formed from zippers, tongue and groove or other mateable type fasteners configured to provide releasable securing. It is contemplated within the scope of the present invention that the end cap members 30 could be provided in alternate shapes in addition to the shapes illustrated herein. Furthermore it should be understood that the end cap members 30 could be provided in alternate sizes.

Figure 3:
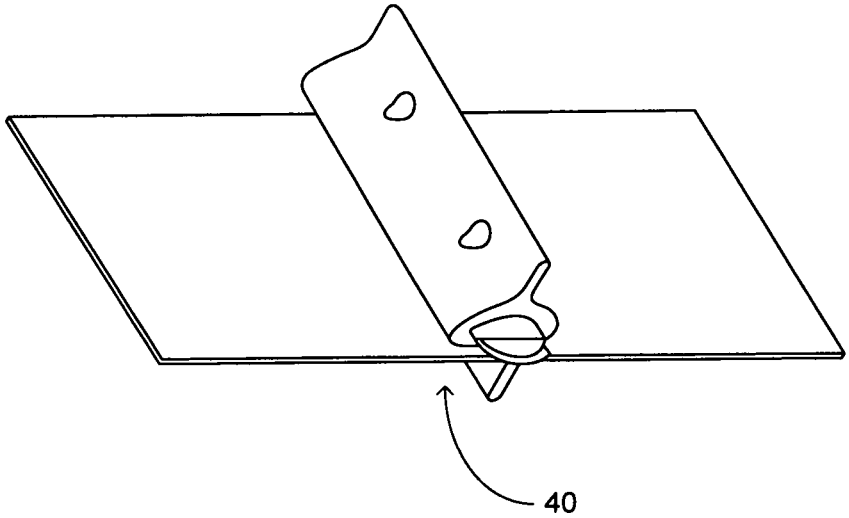
FIG. 3 is a perspective view of a securing element of the present invention.
Figure 4:
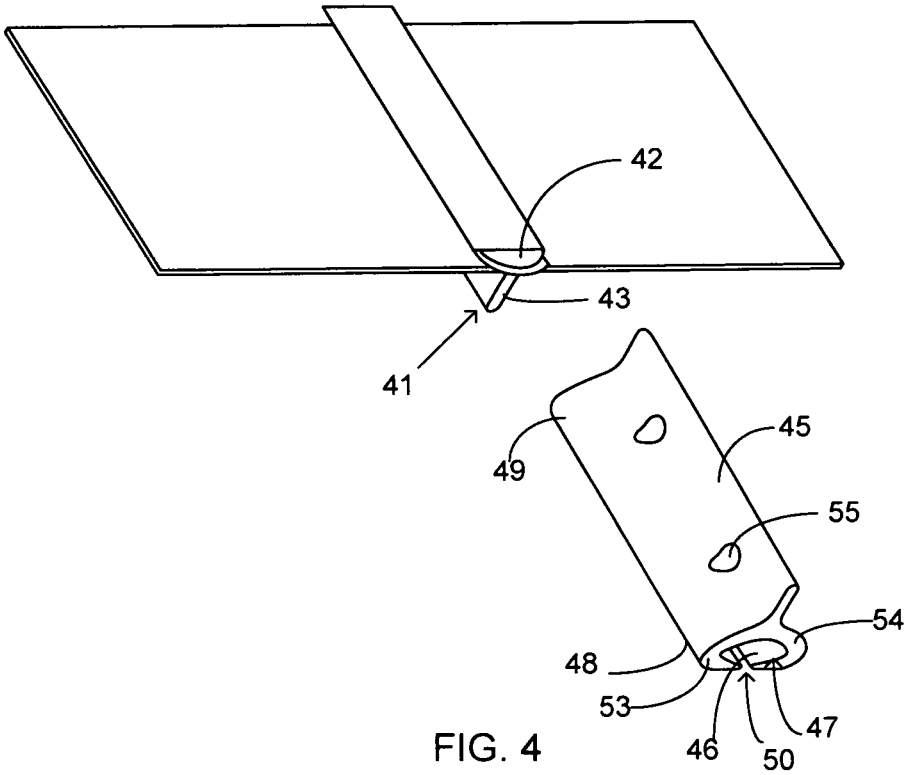
FIG. 4 is a perspective view of a securing element of the present invention.
Figure 5:
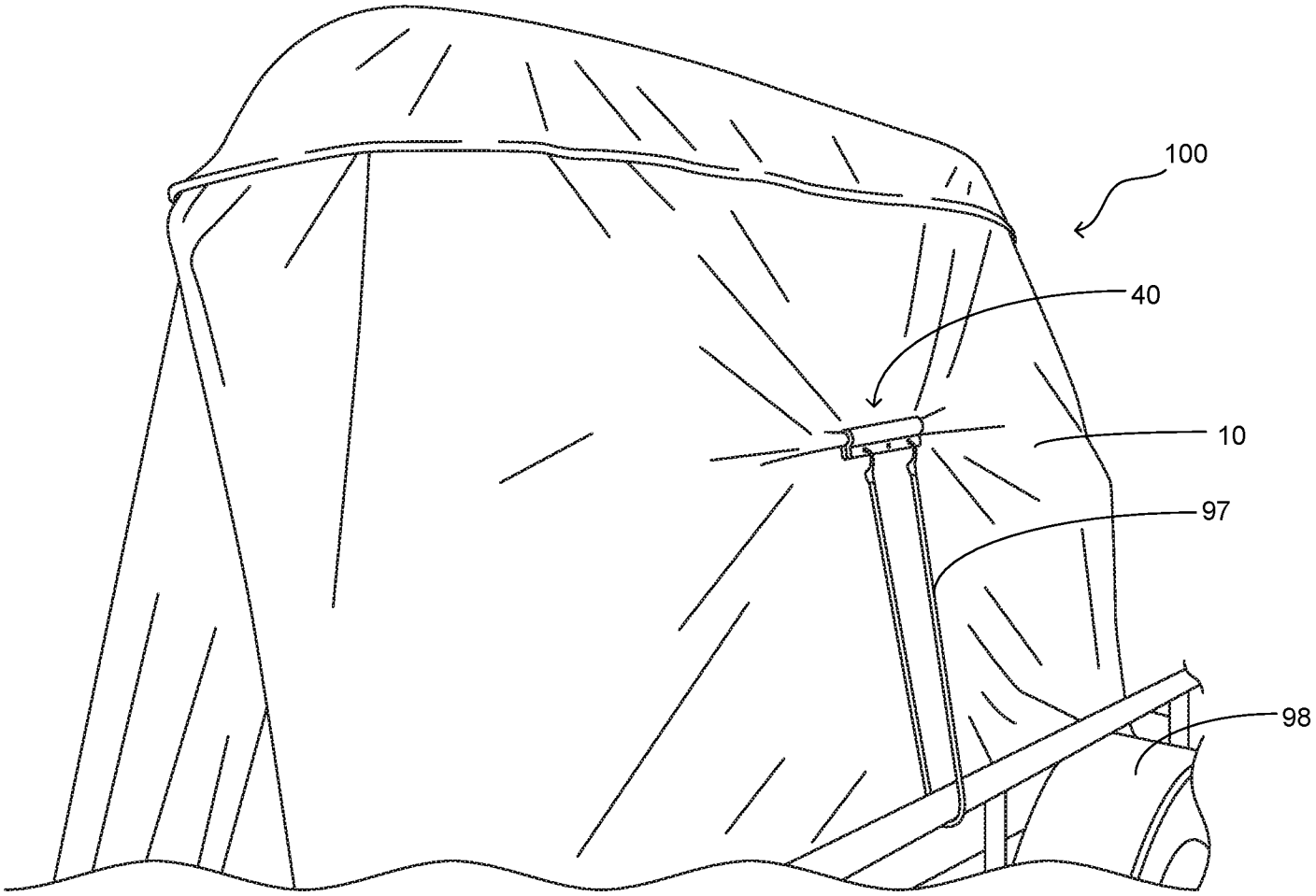
FIG. 5 is a perspective view of an enclosure of the present invention.
Figure 6:
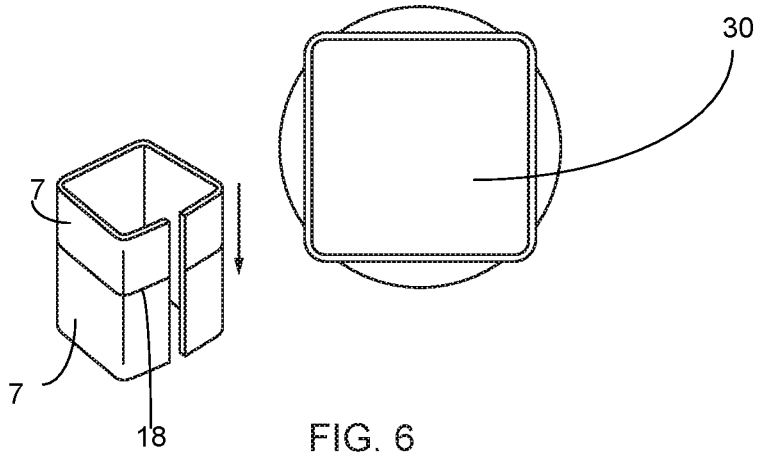
FIG. 6 is a top view of an exemplary end panel and a body panel of the present invention.
Figure 7:
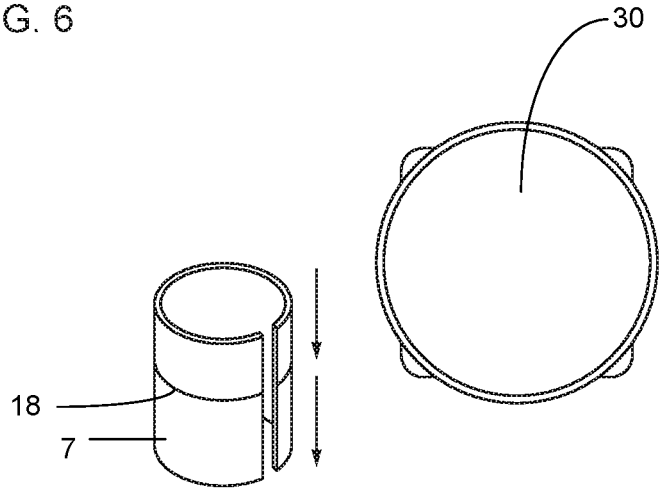
FIG. 7 is a top view of an exemplary end panel and a body panel of the present invention.
Figure 8:
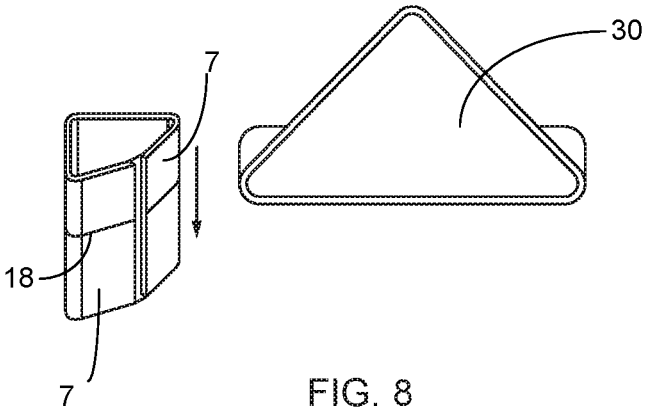
FIG. 8 is a top view of an exemplary end panel and a body panel of the present invention.

Now referring to FIGS. 3 through 5, a preferred securing element 40 is illustrated therein. The securing element 40 is configured to assist in the maintenance of the position of the body 10 of the protective enclosure with pressurization chamber 100 as is illustrated in particular in FIG. 5. FIG. 5 illustrates an exemplary embodiment of the protective enclosure with pressurization chamber 100 superposed and exemplary trailer 98 demonstrating utilization of the securing element 40 configured to provide assistance in the maintaining of the position of the body 40. As is desired within the scope of the present invention to inhibit moisture accumulation and/or propagation into the protective enclosure with pressurization chamber 100, the securing element 40 provides a technique to provide the ability to secure the body 10 without the requirement for apertures/grommets and the like which provide a location for moisture to propagate into the interior volume 14 of the body 10.

The securing element 40 includes rod member 41 and a receiving member 45 that are configured to mateable couple. The rod member 41 includes a first portion 42 and second portion 43 integrally formed. The first portion 42 and second portion 43 are integrally formed at a perpendicular angle. The first portion 42 is surroundably mounted with the material of the body 10. While the rod member 41 is illustrated herein as having a first portion 42 and second portion 43, it is contemplated within the scope of the present invention that the rod member 41 could be formed from a single member that is mateably shaped with the cavity 46 as is further discussed herein.

The rod member 41 is manufactured from a flexible expandable material such as but not limited to rubber. The rod member 41 is configured to be insertable into the receiving member 45. The rod member 41 is manufactured from the aforementioned materials in order to inhibit movement subsequent being inserted into cavity 46. In particular, the receiving member 45 includes a cavity 46 having openings 47 on opposing ends 48, 49. The first portion 42 of the rod member 41 is shaped so as to be mateably inserted through one of the openings 47 and slidably traversed through the cavity 46. The opposing lower walls 53,54 of the receiving member 45 are formed so as to terminate proximate bottom edge 50 wherein the shape and termination point of the opposing lower walls 53, 54 inhibit the removal of the rod member 41 unless a sliding motion is executed. The securing element 40 includes apertures 55 formed in the receiving member 45 wherein the apertures 55 provide engagement of rope 97 or similar item that is utilized to provide securing of the securing element 40 to the trailer 98. It should be understood within the scope of the present invention that the apertures 55 could be present in alternate quantities. Additionally, it should be further understood within the scope of the present invention that the securing element 40 could be provided in alternate lengths and further be positioned in various locations on the body 10 as needed for a desired application.

Figure 13:
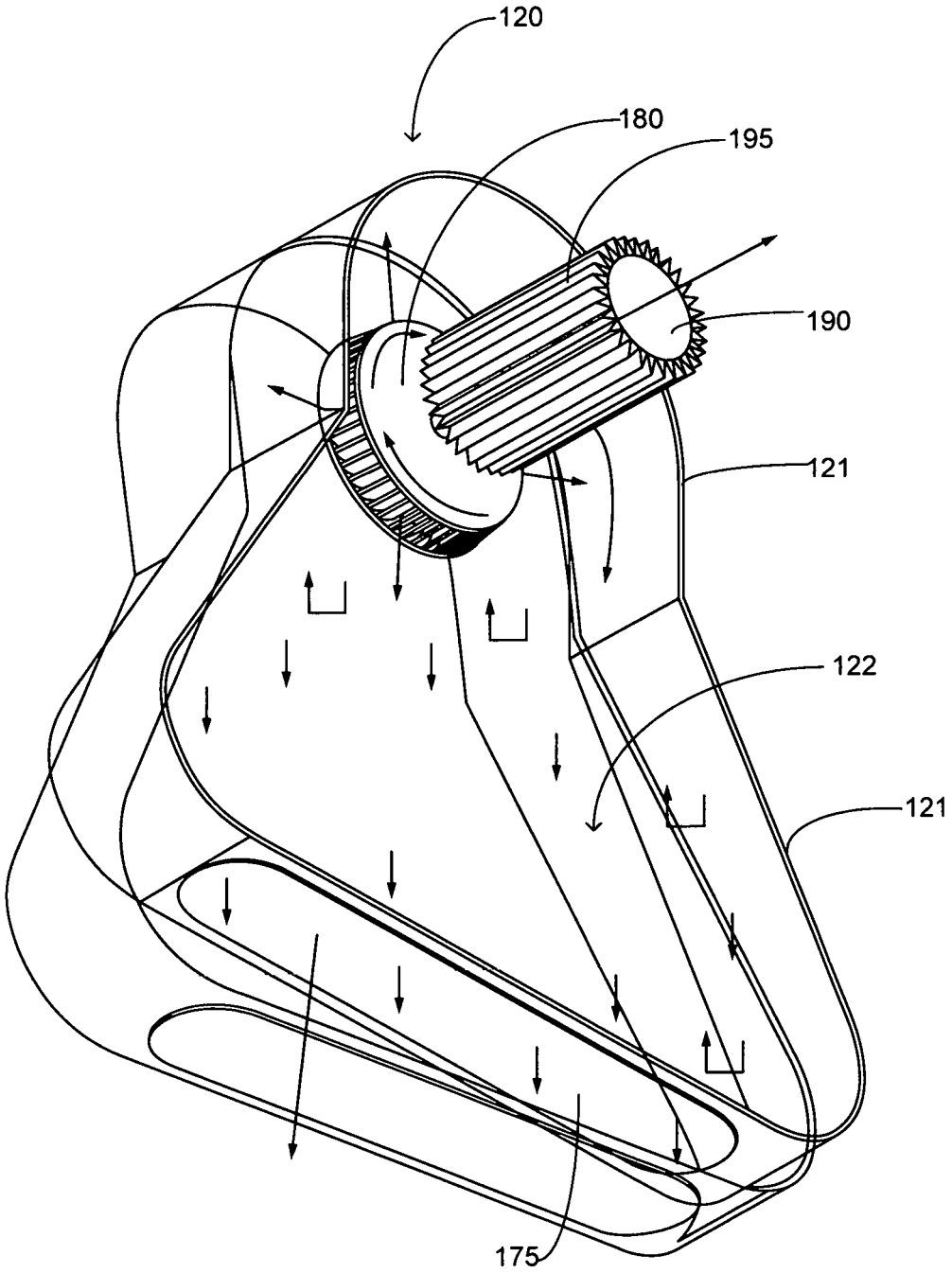
FIG. 13 is an exemplary pressurization chamber of the present invention.

Referring now to FIGS. 1,2 and 13, the protective enclosure with pressurization chamber 100 includes pressurization chamber 20. The pressurization chamber 20 is secured to the body 10 on the outside thereof utilizing suitable durable techniques. The pressurization chamber 20 includes a plurality of walls 21 that are formed to create an interior volume 22. The pressurization chamber 20 is configured to intake atmospheric air through air intake 23 and ultimately direct the air (represented by directional arrows in FIG. 2 herein) through apertures 15. As will be further discussed herein, during the process of cycling the air through the pressurization chamber 20 any moisture and/or matter such as but not limited to dust particulates present in the air will be removed so as to inhibit the introduction of air having a high humidity from being introduced into the interior volume 14 of the body 10.

The pressurization chamber 20 includes a shield member 24 manufactured from a suitable durable material such as but not limited to plastic. The shield member 24 is formed so as to inhibit rain and other precipitation from entering the interior volume 22 of the pressurization chamber 20. It should be understood by those skilled in the art that the shield member 24 could be formed in alternate shapes and sizes in order to achieve the desired objective stated herein. A motor 80 is disposed within the interior volume 22 of the pressurization chamber 20. The motor 80 is similar to a conventional blower motor wherein the motor 80 is operable to draw in air through intake 23 and expel the air into the interior volume 22 of the pressurization chamber 20. The airflow pattern facilitated by the combination of the walls 21 and the apertures 15 provides an airflow pattern that is conducive to achieving the desired reduction of the moisture and other matter within the air disposed in the interior volume 22 of the pressurization chamber 20.

As the air is expelled from the motor 80, the backpressure in the interior volume 22 created by the restrictive apertures 15 facilitates the air engagement with water reducing membrane 75. The water reducing membrane 75 is manufactured from a suitable material such as but not limited to plastic and includes a multitude of small apertures (not particularly illustrated herein) formed therein. As the air cycles through the water reducing membrane 75, the structure thereof provides the ability for any moisture present in the air to be removed. The heavier moist air engages the water reducing membrane 75 for at least several cycles and as the moisture is removed the air will travel to the upper portion of the interior volume 22 and eventually egress through the apertures 15 into the interior volume 14 of the body 10. The pressurization chamber 20 maintains a low pressure pressurization of the interior volume 14 of the body 10 so as to maintain the form of the body 10 and further inhibit introduction of moisture and other matter thereinto from external precipitation and other sources. It should be understood that the interior volume 14 could be maintained at alternate pressures but it is desired that the pressure within the interior volume 14 is at least slightly greater than that of atmospheric pressure.

It should be understood within the scope of the present invention that the pressurization chamber 20 could be formed in alternate shapes and sizes with alternate wall configurations 21 in order to achieve the desired objective discussed herein. It should further be understood within the scope of the present invention that the motor 80 could be provided in alternate sizes and have varying cubic feet per meter ratings. While not particularly illustrated herein, it is further contemplated within the scope of the present invention that the interior volume 22 of the pressurization chamber 20 could have at least one screen disposed therein wherein the screen would be configured to capture any particulates egressing from the motor 80. This screen could be present on the ingress or egress side of the motor 80.

Referring in particular to FIG. 13, an alternative embodiment of the pressurization chamber 120 is illustrated therein. The pressurization chamber 120 includes a plurality of walls 121 integrally formed to create an interior volume 122. The motor 180 is disposed within the interior volume 122 and for this embodiment the motor 180 is a centrifugal style motor wherein the motor 180 expels air in a rotational pattern. As the air is expelled from the motor 180, the air will engage with the water reducing membrane 175 wherein during engagement therewith any moisture present in the air is eliminated. The water reducing membrane 175 is constructed similarly to water reducing membrane 75 previously described herein. The air outlet 190 is sized so as to restrict the airflow into the body 10 and as such create the backpressure within the interior volume 122 as previously discussed herein. A screen 195 is present that is operable to capture and retain and foreign particulates present in the air so as to inhibit introduction into the interior volume 14 of the body 10. It should be understood that the pressurization chamber could be provided in alternate styles and shapes and still achieve the desired objective discussed herein.

The pressurization chamber 120 is operable to provide separation of moisture, dust and other matter in a three-stage process. In the first stage of the process the motor 180 has an intake of the air at low velocity wherein the motor 180 has air ingress thereinto and subsequently egresses the air at a higher velocity. The higher velocity output of the motor 180 and the production of a centrifugal airflow pattern within the interior volume 122 of the pressurization chamber 120 is a processing stage wherein the aforementioned facilitate the removal of moisture and dust. The third stage includes the pressurization stage wherein the body 10 is pressurized with a low velocity airflow.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A portable enclosure that is configured to have an interior volume that has a pressure that is greater than that of the atmospheric pressure of its surroundings wherein the portable enclosure comprises:

a body, said body having at least one wall, said at least one wall having an outer surface and an inner surface, a bottom and a top forming an interior volume, said at least one wall of said body having at least one wall panel, said at least one wall panel configured to be alterable in size, wherein said body further includes two end cap members, said end cap members forming the top and bottom of the body, said end cap members configured to be releasably secured to said at least one wall, said end cap members being provided in alternate shapes and styles;

a pressurization chamber, said pressurization chamber being atmospherically coupled to the interior volume of said body, said pressurization chamber further including an air intake, said pressurization chamber operable to introduce air into the interior volume of the body through at least one aperture formed in said at least one wall, said at least one aperture configured to restrict airflow therethrough so as to create a backpressure within the interior volume of said pressurization chamber so as to facilitate removal of moisture and dust from the airflow, wherein said pressurization chamber further includes a water reducing member, said water reducing member configured to engage airflow within the interior volume of the pressurization chamber, said water reducing member operable to remove moisture from the air disposed within the pressurization chamber.

2. The portable enclosure as recited in claim 1, wherein said at least one wall panel includes at least one perimeter seam, said at least one perimeter seam further including a fastener, said at least one perimeter seam operable to provide expansion of the at least one wall panel.

3. The portable enclosure as recited in claim 2, and further including at least one securing element, said at least one securing element having a first portion and a second portion, said first portion of said at least one securing element configured to mateably couple with said second portion, said at least one securing element operable to secure said body to a desired structure.

4. The portable enclosure as recited in claim 3, wherein said water reducing member further includes a plurality of apertures, said plurality of apertures operable to allow water to egress therethrough.

5. The portable enclosure as recited in claim 4, and further including a shield member, said shield member operable to inhibit precipitation from entering said interior volume of said pressurization chamber.

6. A portable enclosure that is configurable to be expandable in size and have an interior volume that is at a pressure greater than that of its environment wherein the portable enclosure comprises:

a body, said body having at least one wall, a bottom and a top forming and interior volume, said at least one wall including a plurality of wall panels, said plurality of wall panels being configured with perimeter seams, said plurality of wall panels configured to provide expansion of said body, wherein the perimeter seams of the plurality of wall panels further include fasteners, said fasteners configured to facilitate expansion of said plurality of wall panels or releasably secure to an additional wall segment;

a pressurization chamber, said pressurization chamber having an interior volume including a bottom portion and a top portion, said pressurization chamber being atmospherically coupled to the interior volume of said body, said pressurization chamber configured to provide a pressure within said interior volume of said body that is greater than that of its environment, said pressurization chamber further including an air intake, said pressurization chamber operable to introduce air into the interior volume of the body through at least one aperture formed in said at least one wall, said at least one aperture configured to restrict airflow therethrough so as to create a backpressure within the interior volume of said pressurization chamber; and wherein said pressurization chamber includes an interior volume having a plurality of walls that is operable to create an airflow therein operable to reduce moisture and dust from the airflow prior to passing through said at least one aperture.

7. The portable enclosure as recited in claim 6, wherein said interior volume of said pressurization chamber further includes a water reducing member, said water reducing member being proximate the bottom region of said interior volume of said pressurization chamber, said water reducing member having a plurality of apertures, wherein the airflow within the interior volume is passed through the water reducing member prior to passage through the at least one aperture.

8. The portable enclosure as recited in claim 7, wherein said pressurization chamber further includes a shield member, said shield member being secured to said outer surface of said at least one wall of said body, said shield member operable to inhibit precipitation from entering said pressurization chamber.

9. The portable enclosure as recited in claim 8, and further including a plurality of securing elements, said plurality of securing elements having a first portion and a second portion, said first portion of said plurality of securing elements configured to mateably couple with said second portion, said first portion of said plurality of securing elements having a portion of said body secured thereto, said plurality of securing elements operable to secure said body to a desired structure.

10. The portable enclosure as recited in claim 9, and further including end cap members, said end cap members comprising said top and said bottom of said body, said end cap members configured in a shape mateable to said body.

11. The portable enclosure as recited in claim 10, wherein said second portion of said plurality of securing elements includes a cavity, wherein said cavity of said second portion is configured to slidably receive said first portion of said plurality of securing elements.

12. A portable enclosure that is configurable to be expandable in size and further be configured for inhibiting the exposure of moisture and other matter to contents disposed therein:

a body, said body having at least one wall, a bottom and a top forming and interior volume, said at least one wall including a plurality of wall panels, said plurality of wall panels being configured with perimeter seams, said perimeter seams being operable to provide expansion of said plurality of wall panels, said perimeter seams being configured with fasteners, said fasteners operable to be mateably coupled to adjacent fasteners of adjacent perimeter seams;

a pressurization chamber, said pressurization chamber having an interior volume including a bottom portion and a top portion, said pressurization chamber being atmospherically coupled to the interior volume of said body, said pressurization chamber configured to provide a pressure within said interior volume of said body that is greater than that of its environment, said pressurization chamber further including an air intake, said pressurization chamber operable to introduce air into the interior volume of the body through at least one aperture formed in said at least one wall, said at least one aperture configured to restrict airflow therethrough so as to create a backpressure within the interior volume of said pressurization chamber, wherein said pressurization chamber includes three stages including an intake stage, a processing stage and a pressurization stage; and wherein said pressurization chamber includes an interior volume having a plurality of walls that is operable to create an airflow therein operable to reduce moisture and dust from the airflow prior to passing through said at least one aperture.

13. The portable enclosure as recited in claim 12, wherein said body further includes at least one additional body segment, said at least one additional body segment being configured with a plurality of wall panels, said plurality of wall panels being configured with said perimeter seams, said perimeter seams being operable to provide expansion of said at least one additional body segment.

14. The portable enclosure as recited in claim 13, and further including end cap members, said end cap members comprising said top and said bottom of said body, said end cap members configured in a shape mateable to said body, said end cap members being releasably secured to said body.

15. The portable enclosure as recited in claim 14, and further including a plurality of securing elements, said plurality of securing elements having a first portion and a second portion, said first portion of said plurality of securing elements configured to mateably couple with said second portion, said first portion of said plurality of securing elements having a portion of said body secured thereto, said plurality of securing elements operable to secure said body to a desired structure, wherein said second portion of said plurality of securing elements includes a cavity, wherein said cavity of said second portion is configured to slidably receive said first portion of said plurality of securing elements.

16. The portable enclosure as recited in claim 15, wherein said interior volume of said pressurization chamber further includes a water reducing member, said water reducing member being proximate the bottom region of said interior volume of said pressurization chamber, said water reducing member having a plurality of apertures, wherein the airflow within the interior volume is passed through the water reducing member prior to passage through the at least one aperture.

17. The portable enclosure as recited in claim 16, wherein said pressurization chamber further includes a shield member, said shield member being secured to said outer surface of said at least one wall of said body, said shield member operable to inhibit precipitation from entering said pressurization chamber.

* * * * *